US005372654A

United States Patent [19]

Satoh et al.

[11] Patent Number: 5,372,654

[45] Date of Patent: Dec. 13, 1994

[54] STEEL SHEET FOR PRESS WORKING THAT EXHIBITS EXCELLENT STIFFNESS AND SATISFACTORY PRESS WORKABILITY

[75] Inventors: Susumu Satoh; Susumu Okada; Kouichi Hirata; Masahiko Morita, all of Chiba; Tsuguhiko Nakagawa, Okayama, all of Japan

[73] Assignee: Kawasaki Steel Corporation, Kobe, Japan

[21] Appl. No.: 122,357

[22] Filed: Sep. 17, 1993

[30] Foreign Application Priority Data

Sep. 21, 1992 [JP] Japan ..... 4-251239

[51] Int. Cl.[5] ..... C21D 1/06; C22C 38/00

[52] U.S. Cl. ..... 148/217; 148/219; 148/318; 148/319

[58] Field of Search ..... 148/217, 318, 319, 218, 148/219

[56] References Cited

U.S. PATENT DOCUMENTS 4,495,006 1/1985 Aves, Jr. et al. ..... 148/217
4,806,175 2/1989 Wendt ..... 148/217

FOREIGN PATENT DOCUMENTS 49-30620 8/1974 Japan ..... 148/217
55-119164 9/1980 Japan ..... 148/217
58-39736 3/1983 Japan .
58-144430 8/1983 Japan .
59-74259 4/1984 Japan .
60-149729 8/1985 Japan .
1-96330 4/1989 Japan .
3-253543 3/1990 Japan .
3-56644 3/1991 Japan .
3-199343 8/1991 Japan .

*Primary Examiner*—Deborah Yee
*Attorney, Agent, or Firm*—Staas & Halsey

[57] ABSTRACT

The present invention provides a steel sheet for press working that exhibits excellent stiffness and satisfactory press workability. The steel sheet for press working includes: a composition of C+N+B=0.007 to 1.0 wt % in a region from the surface of the steel sheet to a position of 5% of the thickness in a direction of the thickness in at least either of the surface layers; a pole intensity of [{321}+{211}]/{100}≧1.2 in a vertical direction to the sheet surface realized at a 3% thickness position in the direction of the thickness from the surface; and a composition of C+N+B=0.010 wt % less than in the central portion 40% except for two 30% portions of the two surface layers in the direction of the thickness.

11 Claims, 2 Drawing Sheets

STEEL SHEET FOR PRESS WORKING THAT EXHIBITS EXCELLENT STIFFNESS AND SATISFACTORY PRESS WORKABILITY

BACKGROUND OF THE INVENTION

1. Field of the Invention

The present invention relates to a steel sheet that can be suitably press-worked to be formed into a body part of an automobile, and more particularly to a steel sheet for press working that exhibits excellent stiffness and satisfactory press workability.

2. Related Background Art

As a general rule, a steel sheet for press working must exhibit both excellent ductility (a large El value) and satisfactory deep-drawing characteristics (a large r value). In order to cause a steel sheet to have the foregoing characteristics, a method has been usually employed in which the composition of the steel and conditions for the rolling work or heat treatment conditions are controlled at the time of manufacturing the steel sheet. For example, Japanese Patent Laid-Open No. 58-144430 has disclosed a method of minimizing impurity elements, such as C, S and N, that deteriorate the foregoing characteristics.

Recently, there has been a need for the foregoing steel sheet exhibiting the excellent ductility and satisfactory deep-drawing characteristics to further exhibit excellent stiffness. It is well known that stiffness can be improved in proportion to the Young's modulus if the thickness and the molded shape are the same. However, the Young's modulus of the steel sheet cannot be easily controlled to an arbitrary value using the conventional technologies, and therefore, a problem arises in its practicality.

On the other hand, in order to realize the following characteristics, a method of manufacturing a steel sheet for press working that exhibits different characteristics in a direction of the thickness thereof has been disclosed. The foregoing method is an application of a carburizing technology disclosed in, for example, Japanese Patent Laid-Open No. 58-39736, Japanese Patent Laid-Open No. 59-74259, Japanese Patent Laid-Open No. 60-149729, Japanese Patent Laid-Open No. 1-96330, Japanese Patent Laid-Open No. 3-56644, Japanese Patent Laid-Open No. 3-199343 and Japanese Patent Laid-Open No. 3-253543.

However, the conventional technologies disclosed above cannot improve both press workability and stiffness although they are able to improve either of the two characteristics.

SUMMARY OF THE INVENTION

An object of the present invention is to provide a steel sheet for press working that exhibits both excellent stiffness and satisfactory press workability.

According to one aspect of the present invention, there is provided a steel sheet for press working that exhibits excellent stiffness and satisfactory press workability, the steel sheet for press working comprising: a composition of C+N+B=0.007 to 1.0 wt % in a region from the surface of the steel sheet to a position of 5% of the thickness in a direction of the thickness in at least either of the surface layers; a pole intensity of [{321}+{211}]/{100}≧1.2 in a vertical direction to the sheet surface realized at a 3% thickness position in the direction of the thickness from the surface; and a composition of C+N+B=less than 0.010 wt % in the central portion (40%) except for two 30% portions of the two surface layers in the direction of the thickness.

In addition to the foregoing structure, there is provided a steel sheet for press working that exhibits excellent stiffness and satisfactory press workability, wherein the average composition in the overall portion in the direction of the thickness is arranged to comprise: 1.0 wt % or less of C; 2.0 wt % or less of Si, 3.0 wt % or less of Mn; 0.3 wt % or less of P; 0.1 wt % or less of S; one or more element selected from a group consisting of the following elements: 0.01 to 2.0 wt % Cr, 0.01 to 2.0 wt % Ni, 0.01 to 2.0 wt % Mo, 0.002 to 0.2 wt % V, 0.002 to 0.2 wt % Ti, 0.002 to 0.2 wt % Nb, 0.01 to 2.0 wt % Cu, 0.002 to 0.2 wt % Zr, 0.001 to 0.1 wt % Sb, 0.001 to 0.1 wt % Se, 0.001 to 0.1 wt % Ca and 0.001 to 0.2 wt % Al; and a balance consisting of Fe and unavoidable impurities.

According to another aspect of the present invention, there is provided a method of manufacturing a hot-rolled steel sheet for press working that exhibits excellent stiffness and satisfactory press workability comprising the steps of: subjecting, to hot rolling, a steel member composed of 0.010 wt % or less of C+N+B, 2.0 wt % or less of Si, 3.0 wt % or less of Mn, 0.3 wt % or less of P, 0.1 wt % or less of S, one or more elements selected from a group consisting of the following elements: 0.01 to 2.0 wt % Cr, 0.01 to 2.0 wt % Ni, 0.01 to 2.0 wt % Mo, 0.002 to 0.2 wt % V, 0.002 to 0.2 wt % Ti, 0.002 to 0.2 wt % Nb, 0.01 to 2.0 wt % Cu, 0.002 to 0.2 wt % Zr, 0.001 to 0.1 wt % Sb, 0.001 to 0.1 wt % Se, 0.001 to 0.1 wt % Ca and 0.001 to 0.2 wt % Al, and a balance consisting of Fe and unavoidable impurities, the hot rolling being performed at a temperature ranging in $Ar_3 \pm 70°$ C. while making the total reduction ratio of 50% or more and the friction coefficient of 0.25 or less; and performing carburizing, nitriding and boronizing to cause at least one surface layer of the steel sheet from the surface to a position of 5% of the thickness in a direction of the thickness to have a composition expressed by C+N+B=0.007 to 1.0 wt %.

The above-mentioned and other objects and features of the present invention will become more apparent from the following description when read in conjunction with the accompanying drawings. However, the drawings and description are merely illustrative in nature and not restrictive.

DESCRIPTION OF THE PREFERRED EMBODIMENTS

The present invention provides a steel sheet exhibiting excellent stiffness and satisfactory press workability, which can be manufactured by limiting, to respective specific ranges, both total amount of C, N and B in the steel sheet in the direction of the thickness of the steel sheet and a pole intensity [{321}+{211}]/{100} at a specific position in the steel sheet.

Factors influencing the steel sheet according to the present invention are described below.

First, there are the amounts of C, N and B in the surface layer of the steel sheet.

The steel sheet according to the present invention must be arranged so that the total amount of C, N and B ranges from 0.007 to 1.0 wt % in at least one of two surface layers of the steel sheet from the surfaces of the steel sheet to positions of 5% of the overall thickness of the steel sheet in the direction of the thickness of the steel sheet (hereinafter abbreviated to "surface layer of 5% of the thickness"). The foregoing requirement will now be described in detail.

Figure 1:
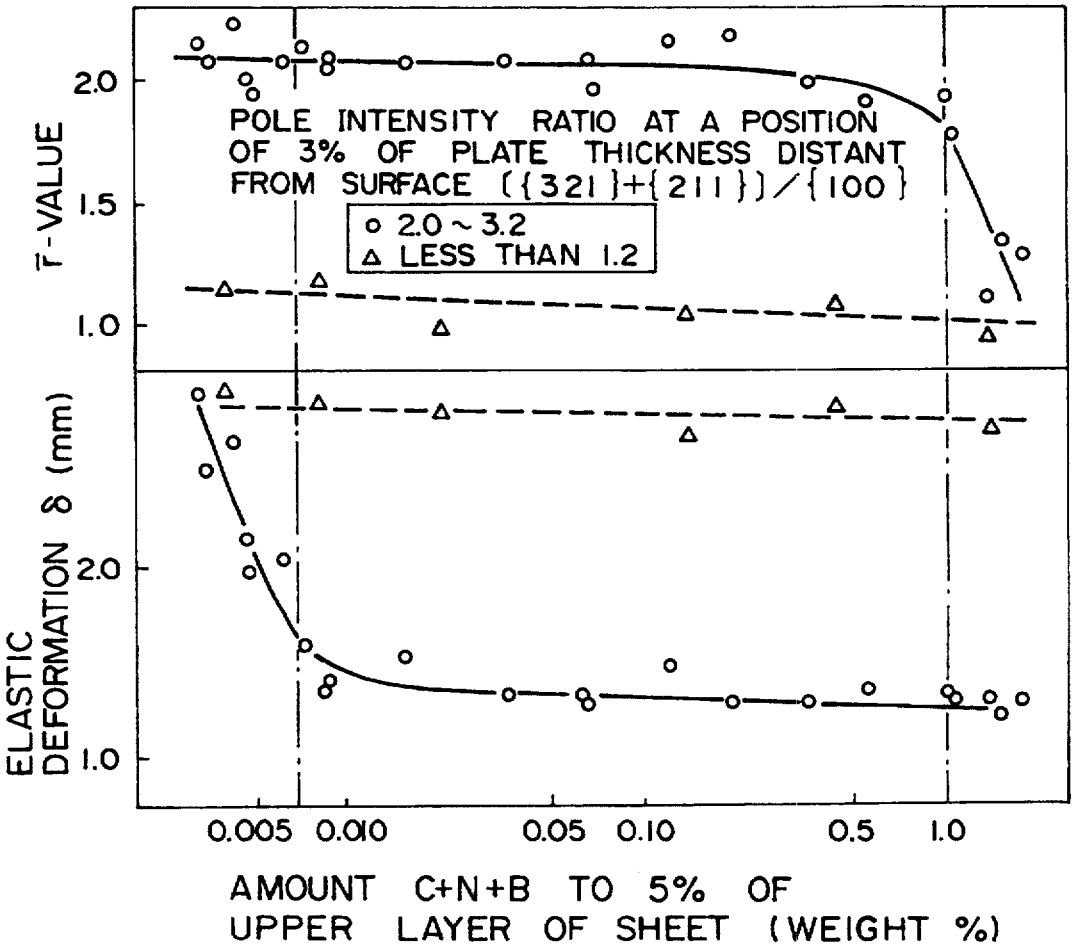
FIG. 1 is a graph showing the influence of amounts of C+N+B in the surface layer and the pole intensity of [{321}+{211}]/{100} upon the stiffness and the deep-drawing characteristics.

A ultra-low-carbon and cold-rolled steel sheet (having a thickness of 0.7 mm) composed of 0.01 wt % Si, 0.20 wt % Mn, 0.012 wt % P, 0.006 wt % S and 0.06 wt % Al has been subjected to carburize, nitride and boronize heat treatment processes to evaluate an influence of the total amount (C+N+B) in the two surface layers of 5% of the thickness of the steel sheet upon a Rankford value (hereinafter called a r-value). The results are shown in FIG. 1.

At the time of the foregoing evaluation, the heat treatment temperature, hot rolling condition or cold rolling condition were controlled to evaluate an influence of the pole intensity: [{321}+{211}]/{100}=less than 1.2 and that of the change of the pole intensity from 2.0 to 3.2 at the 3% position from the surface of the steel sheet in the direction of the thickness of the steel sheet. The stiffness was examined as well. The stiffness was evaluated with the elastic deformation δ(mm) so that a sample projecting upwardly and having a curvature radius of 1000 mm was used, the distance between supporting points was made to be 300 mm and a load of 10 kg was applied to an intermediate position between the supporting points.

Components of the steel sheet subjected to the evaluation except for C, N and B were, on the average in the direction of the thickness, 0.01 wt % Si, 0.20 wt % Mn, 0.012 wt % P, 0.006 wt % S, 0.06 wt % Al, 0.03 wt % Ti and 0.007 wt % Nb. Further, the total amount of C+N+B at the central portion (40%) except for the two surface layers of 30% of the thickness was 0.0045 to 0.0067%.

Further, an experiment was carried out in which the pole intensity [{321}+{211}]/{100} at the 3% thickness position in the direction of the thickness was changed so that a steel sheet having the same composition was used as the starting material, and the hot and cold rolling conditions (the temperature, the reduction ratio and the friction coefficient) were changed. As the final treatment at this time, carburizing was performed while making the quantity of C in the 5% thickness portion in the surface layer to be about 0.025 wt % and the total amount of C+N+B to be 0.029 wt %. In addition, the amount of C+N+B in the central portion except for the two 30% portions in the two surface layers was 0.0057 wt %.

Figure 2:
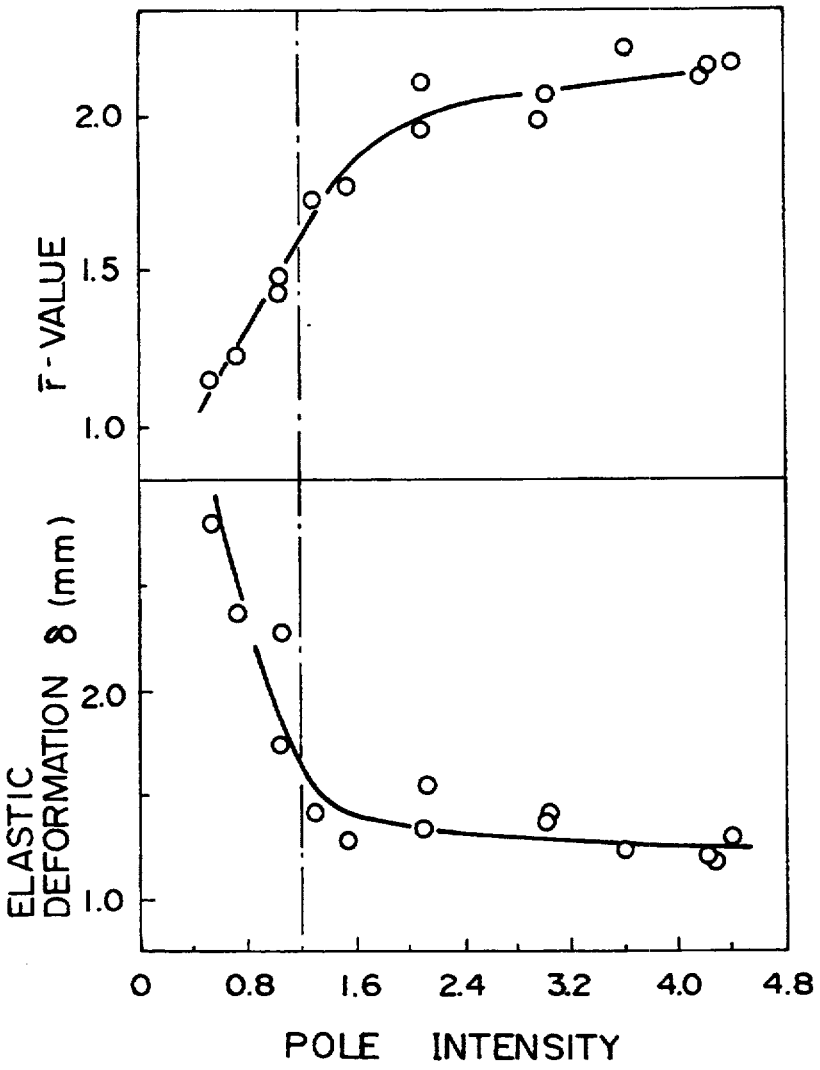
FIG. 2 is a graph showing the relationship among the pole intensity [{321}+{211}]/{100} at a 3% thickness position from the surface in the direction of the thickness, the stiffness (δ) and the deep-drawing characteristics (r-value).

As can be understood from the results shown in FIGS. 1 and 2, it is effective to make the amounts of C+N+B in the 5% portion of the thickness in the surface layer range from 0.007 wt % to 1.0 wt %. In addition, by making the pole intensity [{321}+{211}]/{100} at a 3% thickness position from the surface of the sheet in the direction of the thickness of the sheet to be 1.2 or more, a steel sheet exhibiting both large r-value (a high deep-drawing characteristic) and satisfactory stiffness can be obtained.

Further, the relationships of the pole intensity at the 3% thickness position with surfaces {111} and {110} were examined. The results indicated that the relationship expressed by the foregoing expression enabled characteristics meeting both the stiffness and r-value requirements to be realized.

The preferred range for the total amount of C, N and B in the 5% thickness portion is 0.010 to 0.9%, while the preferred range for the pole intensity [{321}+{211}]/{100} at the 3% thickness position is 1.5 or more.

Further, the steel sheet according to the present invention must be arranged so that the amount of C, N and B in the central portion (40%), except for the two 30% thickness portions in the two surface layers, is less than 0.010 wt %. If the foregoing elements are present in a quantity larger than the foregoing values, the press workability, and in particular, the deep-drawing characteristics (the r-value) are affected adversely. The preferred range for the total amount of C+N+B in the central portion is 0.01 wt % or less.

As described above, the steel sheet according to the present invention enables an effect to be obtained if the amount of C+N+B in each portion in the direction of the thickness and the pole intensity at a specific position are included in the foregoing respective range. Although the reason for this has not been clear yet, the following consideration can be made.

As for the total amount of C+N+B, the portions to the 5% positions in the surface layers and the other central portion are considered individually because different effects are attained from the foregoing portions. Since the stiffness of the surface portions of the steel sheet can be improved by making use of the distortion phenomenon of the atomic bonds, an advantage in terms of improving the rigidity can be obtained in proportion to the thickness of the surface layer. However, it was discovered that an increase in the total amount of C+N+B in the central portion in the direction of the thickness excessively deteriorates the workability (the deep-drawing characteristics and the buckling characteristics).

Therefore, the stiffness was improved by enlarging the total amount of C+N+B in the 5% thickness surface layer, and the workability was improved by making the amount of C+N+B in the central portion 40%, except for the two surface layers of 30%, to be less than 0.010%.

It should be noted that the present invention may be arranged so that the total amount of C+N+B is continuously changed from the surface to the central portion in the direction of the thickness while meeting the foregoing conditions.

The reason why the pole intensity at the 3% thickness position is limited is that an aggregate to the 5% thickness position from the surface layer is important. Therefore, the 3% thickness position is employed as a typical position in the 5% thickness surface layer, and the pole intensity at the foregoing position is specified as described above. It should be noted that the regions except for the foregoing 3% thickness position, for example, the central portion is not limited.

The final product of the present invention may be a hot-rolled steel sheet or a cold-rolled steel sheet. It is preferable that the thickness of the hot-rolled steel sheet be about 1.2 to 6.0 mm and that of the cold-rolled steel sheet be about 0.1 to 3.0 mm.

The reasons why the composition of the steel sheet according to the present invention is limited are described below.

C: If C is present by 1.0 wt % or more on the average of the overall portion in the direction of the thickness, the ductility deteriorates excessively. Therefore, the content of C is preferably 1.0 wt % or less.

Si: Although Si is very effective to serve as a solution enhancing element, the workability, and in particular, the ductility and the durability against the secondary machining brittleness deteriorate inevitably if the content is larger than 2.0 wt %. Therefore, the content of Si is preferably 2.0 wt %.

Mn: Although Mn is very effective to serve as a solution enhancing element, the workability, and in particular, the deep-drawing characteristics deteriorate excessively if the content is larger than 3.0 wt %. Therefore, the content of Si is preferably be 3.0 wt %.

P: Although P is very effective to serve as a solution enhancing element, the durability against the secondary machining brittleness deteriorates excessively if the content is larger than 0.3 wt %. Therefore, the content of P is preferably 0.3 wt %.

S: If the content of S is larger than 0.1 wt %, the corrosion resistance deteriorates excessively. Therefore, the content of S is preferably 0.1 wt % or less.

Al: Since Al is an effective deoxidizer, it must be added in a quantity of 0.001 wt % or more. However, surface failure arises frequently if the content is 0.2 wt % or more. Therefore, the content of Al is preferably 0.2 wt % or less.

TI, Nb, V and Zr: The foregoing elements are carbide and nitride forming elements and effective to improve the workability, and in particular, the deep-drawing characteristics. Therefore, it is preferable to add the foregoing elements in a quantity of 0.002 wt % or more. However, if each content is 0.2 wt %, the effect is saturated and the ductility deteriorates excessively. Therefore, the content is preferably 0.2 wt % or less.

Ni, Cu, Cr and Mo: The foregoing elements are effective to serve as solution enhancing elements, and therefore, it is preferable to add them in a quantity of 0.01 wt % or more. However, if the content is larger than 2.0 wt %, the ductility deteriorates excessively. Therefore, the content is preferably 2.0 wt % or less.

Sb, Se and Ca: The foregoing elements are effective to improve the weldability and the workability, and therefore, they may be added in a quantity of 0.001 wt % or more. If the content is larger than 0.1 wt %, the surface treatment, such as the carburizing, deteriorates. Therefore, the content is preferably 0.1 wt % or less.

A method of manufacturing the steel sheet according to the present invention is described below.

The steel sheet, in which the surface layer thereof and the central portion thereof are composed in a different manner (that is contents of C, N and B are varied), can be manufactured by the following methods.

For example, it is preferable to employ a method having the steps of: subjecting a steel member, in which the total amount of C+N+B is previously made to be less than 0.01 wt %, to hot rolling or both hot rolling and cold rolling to prepare a hot-rolled steel sheet or a cold-rolled steel sheet; and subjecting, in an annealing process, the hot-rolled steel sheet or the cold-rolled steel sheet to carburizing, nitriding and boronizing. In particular, it is advantageous in terms of improving productivity to employ a method in which annealing and equal heat treatment are performed and the foregoing processes, such as the carburizing, are continuously performed to improve the workability. Although a casting clad method or a bonding method may be adopted, the present invention can be embodied with any one of the foregoing methods without any particular limitation.

As a method of controlling the pole intensity [{321}+{211}]/{100} at the 3% thickness position, that is a method of making the pole intensity to be 1.2 or more, it is preferable to employ, for example, a method in which hot rolling is performed at a temperature in a range of $Ar_3 \pm 70°$ C. while making the total reduction ratio 50% or more and the friction coefficient 0.25 or less. As for the cold-rolled steel sheet, it is preferable to cold-roll said hot-rolled steel sheet at a reduction ratio of 7% or more set in the final rolling path while making the friction coefficient 0.12 or less.

EXAMPLE

In this example, slabs, the components of each of which except for C, N and B have been adjusted, were prepared, the slabs being then hot-rolled. A portion of the hot-rolled sheets were further cold-rolled, so that test sheets of hot-rolled steel sheets and cold-rolled steel sheets were prepared. The average amounts of C, N and B of the test sheets in the direction of the thickness approximated to the components (in the central portion) of the final product except for the two 30% portions in the two surface layers.

The test sheets of hot-rolled steel sheets and cold-rolled steel sheets were obtained under the following steps.

The hot-rolling process was performed in the three final stands in the finish rolling process at a temperature ranging in $Ar_3 \pm 45°$ C. while making the total reduction ratio 55% to 65% and the friction coefficient 0.23 to 0.12 or less. The coiling-up temperature after the hot rolling process had been completed was set to 635° C. to 546° C. The hot-rolled steel sheets were then cleaned with acid, and rolled by using a cold rolling tandem mill at a reduction ratio of 14 to 33% and a friction coefficient of 0.08 to 0.11 in the final rolling path.

The surfaces of the foregoing hot-rolled steel sheets and the cold-rolled steel sheets were impregnated with C and N in such a manner that they are impregnated with C in an atmosphere containing CO gas and impregnated with N in an atmosphere containing $NH_3$ gas. The cold-rolled steel sheets were subjected to an equal heating re-crystallization process, and then impregnated with C and N in an individual zone. The hot-rolled sheets do not need to be subjected to the re-crystallization process. The carburizing and nitriding were performed at a temperature ranging from 730° to 900° C. for a processing time of 20 to 180 seconds. The boronizing was performed in such a manner that the steel sheets were allowed to pass through a zone in which boron carbide was heated to 800° to 1000° C. If galvanealing is performed, heat treatment was performed in a line having an annealing zone, carburizing and nitriding are performed in individual zones, and then continuously subjected to galvanizing-alloying process (490° C. to 520° C.).

Tables 1 to 4 show the total amount of C+N+B at the 5% position in the surface layer, the total amount of C+N+B in the central portion (40%) except for the two 30% portions in the two surface layers, the average component concentration in the overall portion in the direction of the thickness, and the characteristics of the material, such as the type of the product and the thickness.

The pole intensity at the 3% thickness position from the surface was measured by an X-ray method, while the mechanical characteristics (YS and the like) were measured by a JIS No. 5 test specimen.

Each of steel sheets A3, A9 and B8 has a hard phase in either surface layer thereof.

As can be understood from the results shown in Tables 2 and 4, the examples A1 to A11, B6 to B8 and B13 to B15 according to the present invention exhibit a large r-value (excellent deep-drawing characteristics) and low δ (high stiffness).

The steel sheets A2, A3, A5, A6, A8, B6, B7 and B15 starting from the hot-rolled steel sheets and cold-rolled steel sheets and subjected to the surface treatment, such as Zn—Ni alloy electroplating and galvanealing, confirms that a steel sheet subjected to the surface-treatment, which does not deteriorate the press workability and the stiffness, can be manufactured.

As described above, according to the present invention, the adequate arrangement of the chemical component in the surface layer of the steel sheet and the aggregate structure enables a steel sheet exhibiting both excellent press workability and satisfactory stiffness to be manufactured.

The steel sheet according to the present invention may be used as a steel sheet subjected to surface treatment such as alloy electroplating or galvanealing etc.

Although the invention has been described in its preferred form with a certain degree of particularity, it is understood that the present disclosure of the preferred form may be changed in the details of construction and that the combination and arrangement of parts may be changed without departing from the spirit and the scope of the invention as hereinafter claimed.

TABLE 1

(WT %)

| | COMPOSITION IN 5% THICKNESS SURFACE LAYER | | | | COMPOSITION IN CENTRAL PORTION EXCEPT TWO 30% THICKNESS PORTIONS | | | | AVERAGE COMPOSITION IN THE DIRECTION OF THICKNESS | | | | | | | |
|---|---|---|---|---|---|---|---|---|---|---|---|---|---|---|---|---|
| | C | N | B | C + N + B | C | N | B | C + N + B | Si | Mn | P | S | Al | Others | | REMARKS |
| A1 | 0.0074 | 0.0026 | 0.0001 | 0.0101 | 0.0027 | 0.0024 | 0.0001 | 0.0052 | 0.01 | 0.12 | 0.013 | 0.006 | 0.03 | Ti | 0.040 | EXAMPLES |
| A2 | 0.0096 | 0.0022 | 0.0002 | 0.0120 | 0.0035 | 0.0020 | 0.0002 | 0.0057 | 0.26 | 0.22 | 0.010 | 0.003 | 0.05 | Ti | 0.032 | OF THE IN- |
| | | | | | | | | | | | | | | Nb | 0.009 | VENTION |
| A3 | 0.016 | 0.0017 | 0.0012 | 0.0189 | 0.00018 | 0.0014 | 0.0010 | 0.0042 | 0.02 | 0.35 | 0.08 | 0.015 | 0.06 | Ti | 0.012 | |
| | | | | | | | | | | | | | | Nb | 0.018 | |
| A4 | 0.065 | 0.0021 | 0.0014 | 0.0685 | 0.0027 | 0.0017 | 0.0005 | 0.0049 | 0.01 | 1.1 | 0.009 | 0.001 | 0.05 | Nb | 0.032 | |
| A5 | 0.272 | 0.0031 | 0.0003 | 0.2754 | 0.0040 | 0.0016 | 0.0002 | 0.0058 | 0.72 | 0.51 | 0.010 | 0.006 | 0.03 | Ti | 0.027 | |
| | | | | | | | | | | | | | | V | 0.011 | |
| A6 | 0.854 | 0.0018 | 0.0001 | 0.8559 | 0.0052 | 0.0016 | 0.0001 | 0.0069 | 0.35 | 1.2 | 0.005 | 0.002 | 0.04 | Ti | 0.010 | |
| | | | | | | | | | | | | | | Nb | 0.031 | |
| | | | | | | | | | | | | | | v | 0.009 | |
| A7 | 0.021 | 0.031 | 0.0008 | 0.0528 | 0.0022 | 0.0031 | 0.0006 | 0.0059 | 0.11 | 0.31 | 0.012 | 0.006 | 0.002 | | — | |
| A8 | 0.0056 | 0.283 | 0.0011 | 0.2897 | 0.0009 | 0.0048 | 0.0009 | 0.0066 | 0.01 | 0.22 | 0.008 | 0.011 | 0.07 | V | 0.052 | |
| A9 | 0.0031 | 0.0022 | 0.0080 | 0.0133 | 0.0028 | 0.0022 | 0.0005 | 0.0055 | 0.01 | 0.08 | 0.063 | 0.007 | 0.02 | Nb | 0.036 | |
| | | | | | | | | | | | | | | V | 0.015 | |
| A10 | 0.035 | 0.0018 | 0.0115 | 0.0483 | 0.0022 | 0.0019 | 0.0011 | 0.0052 | 0.01 | 0.13 | 0.013 | 0.010 | 0.05 | Ti | 0.070 | |
| | | | | | | | | | | | | | | Zr | 0.02 | |
| A11 | 0.0016 | 0.027 | 0.0075 | 0.0361 | 0.0008 | 0.0022 | 0.0009 | 0.0039 | 0.01 | 0.10 | 0.009 | 0.006 | 0.04 | | — | |
| A12 | 0.0035 | 0.0022 | 0.0007 | 0.0064 | 0.0023 | 0.0023 | 0.0008 | 0.0054 | 0.02 | 0.31 | 0.022 | 0.005 | 0.03 | Ti | 0.040 | COMPAR- |
| | | | | | | | | | | | | | | Nb | 0.003 | ATIVE |
| A13 | 0.932 | 0.085 | 0.0011 | 1.0181 | 0.0046 | 0.0012 | 0.0003 | 0.0061 | 0.03 | 0.16 | 0.017 | 0.003 | 0.02 | Zr | 0.05 | EXAMPLES |
| A14 | 0.295 | 0.0031 | 0.0005 | 0.2986 | 0.0065 | 0.0025 | 0.0020 | 0.0110 | 0.01 | 0.09 | 0.003 | 0.005 | 0.05 | Zr | 0.03 | |
| | | | | | | | | | | | | | | V | 0.12 | |
| A15 | 0.017 | 0.0018 | 0.0002 | 0.0190 | 0.0023 | 0.0016 | 0.0001 | 0.0040 | 0.01 | 0.82 | 0.08 | 0.010 | 0.06 | Ti | 0.050 | |
| | | | | | | | | | | | | | | Nb | 0.010 | |

TABLE 2

| No. | TYPE OF PRODUCT | THICKNESS (mm) | POLE INTENSITY AT 3% THICKNESS POSITION FROM SURFACE [(321) + (211)]/(100) | YS (MPa) | TS (MPa) | El (%) | $\bar{r}$ | ELASTIC OF DEFORMATION δ (mm) | REMARKS |
|---|---|---|---|---|---|---|---|---|---|
| A1 | COLD ROLLED STEEL SHEET | 0.7 | 3.1 | 172 | 310 | 51 | 2.2 | 1.3 | EXAMPLES |
| A2 | Zn—Ni ALLOY ELECTROPLATED COLD-ROLLED STEEL SHEET | 0.7 | 2.2 | 205 | 343 | 45 | 2.1 | 1.2 | OF THE INVENTION |
| A3 | GALVANEALING COLD-ROLLED STEEL SHEET | 0.7 | 2.8 | 232 | 396 | 42 | 2.2 | 1.2 | |
| A4 | COLD-ROLLED STEEL SHEET | 0.7 | 3.9 | 286 | 456 | 36 | 2.0 | 1.3 | |
| A5 | Zn—Ni ALLOY ELECTROPLATED COLD-ROLLED STEEL SHEET | 0.7 | 3.2 | 321 | 507 | 32 | 1.9 | 1.1 | |
| A6 | GALVANEALING COLD-ROLLED STEEL SHEET | 0.7 | 4.3 | 354 | 612 | 24 | 1.8 | 1.2 | |
| A7 | HOT ROLLED STEEL SHEET | 1.4 | 1.7 | 248 | 405 | 44 | 1.4 | 0.7 | |
| A8 | GALVANEALING HOT-ROLLED STEEL SHEET | 1.4 | 2.7 | 298 | 446 | 36 | 1.3 | 0.6 | |
| A9 | COLD-ROLLED STEEL SHEET | 0.7 | 4.2 | 193 | 351 | 44 | 2.2 | 1.3 | |
| A10 | COLD-ROLLED STEEL SHEET | 0.7 | 3.1 | 228 | 396 | 43 | 2.1 | 1.2 | |
| A11 | COLD-ROLLED STEEL SHEET | 0.7 | 2.8 | 215 | 378 | 43 | 2.0 | 1.1 | |

TABLE 2-continued

| No. | TYPE OF PRODUCT | THICKNESS (mm) | POLE INTENSITY AT 3% THICKNESS POSITION FROM SURFACE [(321) + (211)]/(100) | YS (MPa) | TS (MPa) | El (%) | $\bar{r}$ | ELASTIC OF DEFORMATION δ (mm) | REMARKS |
|---|---|---|---|---|---|---|---|---|---|
| A12 | COLD-ROLLED STEEL SHEET | 0.7 | 4.7 | 176 | 308 | 48 | 1.8 | 2.6 | COMPARATIVE EXAMPLES |
| A13 | COLD-ROLLED STEEL SHEET | 0.7 | 3.6 | 465 | 625 | 11 | 0.8 | 1.4 | |
| A14 | COLD-ROLLLD STEEL SHEET | 0.7 | 1.8 | 342 | 461 | 18 | 0.9 | 1.3 | |
| A15 | COLD-ROLLED STEEL SHEET | 0.7 | 0.9 | 340 | 451 | 19 | 0.9 | 3.1 | |

TABLE 3

(WT %)

| | COMPOSITION IN 5% THICKNESS SURFACE LAYER | | | | COMPOSITION IN CENTRAL PORTION EXCEPT TWO 30% THICKNESS PORTIONS | | | | AVERAGE COMPOSITION IN THE DIRECTION OF THICKNESS | | | | | | | |
|---|---|---|---|---|---|---|---|---|---|---|---|---|---|---|---|---|
| | C | N | B | C + N + B | C | N | B | C + N + B | Si | Mn | P | S | Al | Others | | REMARKS |
| B1 | 0.074 | 0.0021 | 0.0005 | 0.0766 | 0.0031 | 0.0016 | 0.0002 | 0.0049 | 0.02 | 0.3 | 0.012 | 0.006 | 0.25 | | — | COMPARATIVE EXAMPLES |
| B2 | 0.062 | 0.0016 | 0.0002 | 0.0683 | 0.0042 | 0.0019 | 0.0002 | 0.0063 | 0.01 | 0.1 | 0.010 | 0.010 | 0.03 | Ti | 0.22 | |
| B3 | 0.082 | 0.0019 | 0.0011 | 0.0850 | .00038 | 0.0021 | 0.0008 | 0.0067 | 0.01 | 0.1 | 0.022 | 0.005 | 0.05 | V | 0.24 | |
| B4 | 0.058 | 0.0022 | 0.0007 | 0.0609 | 0.0026 | 0.0022 | 0.0005 | 0.0053 | 0.01 | 0.2 | 0.020 | 0.007 | 0.03 | Nb | 0.21 | |
| B5 | 0.060 | 0.0018 | 0.0005 | 0.0623 | 0.0033 | 0.0017 | 0.0007 | 0.0057 | 0.02 | 0.2 | 0.010 | 0.005 | 0.05 | Zr | 0.23 | |
| B6 | 0.071 | 0.0022 | 0.0001 | 0.0733 | 0.0022 | 0.0019 | 0.0001 | 0.0042 | 0.01 | 0.1 | 0.013 | 0.016 | 0.07 | Ti<br>Ni | 0.035<br>1.2 | EXAMPLES OF THE INVENTION |
| B7 | 0.068 | 0.0025 | 0.0007 | 0.0712 | 0.0023 | 0.0026 | 0.0007 | 0.0056 | 0.02 | 0.3 | 0.015 | 0.006 | 0.04 | Ti<br>Ni<br>Cu | 0.038<br>1.0<br>1.3 | |
| B8 | 0.056 | 0.0022 | 0.0025 | 0.0607 | 0.0018 | 0.0017 | 0.0005 | 0.0040 | 0.01 | 0.2 | 0.007 | 0.003 | 0.03 | Nb<br>Cr<br>Mo | 0.026<br>1.5<br>0.3 | |
| B9 | 0.086 | 0.0017 | 0.0003 | 0.0880 | 0.0028 | 0.0016 | 0.0002 | 0.0046 | 0.02 | 0.1 | 0.013 | 0.013 | 0.08 | Ni<br>Mo | 2.2<br>0.1 | COMPARATIVE EXAMPLES |
| B10 | 0.066 | 0.0022 | 0.0006 | 0.0688 | 0.0031 | 0.0018 | 0.0016 | 0.0065 | 0.01 | 0.2 | 0.012 | 0.008 | 0.03 | Ni<br>Cu | 0.7<br>2.3 | |
| B11 | 0.016 | 0.0018 | 0.0011 | 0.0189 | 0.0020 | 0.0020 | 0.0010 | 0.0050 | 0.01 | 0.3 | 0.011 | 0.011 | 0.05 | Nb<br>Cr | 0.026<br>2.5 | |
| B12 | 0.023 | 0.0025 | 0.0003 | 0.0258 | 0.0023 | 0.0026 | 0.0002 | 0.0051 | 0.02 | 0.1 | 0.013 | 0.001 | 0.03 | Ti<br>Mo | 0.052<br>2.2 | |
| B13 | 0.011 | 0.0022 | 0.0001 | 0.0133 | 0.0017 | 0.0021 | 0.0002 | 0.0040 | 0.01 | 0.3 | 0.021 | 0.005 | 0.04 | Ti<br>Sb | 0.032<br>0.010 | EXAMPLES OF THE INVENTION |
| B14 | 0.0090 | 0.0019 | 0.0007 | 0.0116 | 0.0013 | 0.0018 | 0.0006 | 0.0037 | 0.02 | 0.3 | 0.016 | 0.003 | 0.05 | Nb<br>Se | 0.009<br>0.012 | |
| B15 | 0.0076 | 0.0022 | 0.0002 | 0.0100 | 0.0018 | 0.0020 | 0.0001 | 0.0039 | 0.01 | 0.1 | 0.008 | 0.002 | 0.07 | Ti<br>Ca | 0.060<br>0.003 | |

TABLE 4

| No. | TYPE OF PRODUCT | THICKNESS (mm) | POLE INTENSITY AT 3% THICKNESS POSITION FROM SURFACE [(321) + (211)]/(100) | YS (MPa) | TS (MPa) | El (%) | $\bar{r}$ | ELASTIC OF DEFORMATION δ (mm) | REMARKS |
|---|---|---|---|---|---|---|---|---|---|
| B1 | COLD ROLLED STEEL SHEET | 0.7 | 3.5 | 293 | 412 | 32 | 0.9 | 1.5 | COMPARATIVE EXAMPLE |
| B2 | COLD ROLLED STEEL SHEET | 0.7 | 2.2 | 305 | 423 | 31 | 0.8 | 1.4 | |
| B3 | COLD ROLLED STEEL SHEET | 0.7 | 5.5 | 303 | 431 | 28 | 0.7 | 1.4 | |
| B4 | COLD-ROLLED STEEL SHEET | 0.7 | 2.8 | 321 | 441 | 31 | 0.8 | 1.3 | |
| B5 | COLD-ROLLED STEEL SHEET | 0.7 | 5.2 | 287 | 428 | 32 | 0.9 | 1.2 | |
| B6 | Zn—Ni ALLOY ELECTROPLATED COLD-ROLLED STEEL SHEET | 0.7 | 2.6 | 278 | 451 | 36 | 1.8 | 1.3 | EXAMPLE OF THE INVENTION |
| B7 | GALVANEALING COLD-ROLLED STEEL SHEET | 0.7 | 4.1 | 321 | 505 | 33 | 1.8 | 1.3 | |
| B8 | COLD-ROLLED STEEL SHEET | 0.7 | 2.2 | 297 | 487 | 34 | 1.7 | 1.2 | |
| B9 | COLD-ROLLED STEEL SHEET | 0.7 | 3.1 | 285 | 402 | 31 | 1.0 | 1.4 | COMPARATIVE EXAMPLES |
| B10 | COLD-ROLLED STEEL SHEET | 0.7 | 3.1 | 306 | 415 | 28 | 0.9 | 1.3 | |
| B11 | COLD-ROLLED STEEL SHEET | 0.7 | 3.2 | 325 | 421 | 27 | 0.8 | 1.5 | |
| B12 | COLD-ROLLED STEEL SHEET | 0.7 | 5.5 | 492 | 561 | 13 | 0.8 | 1.2 | |
| B13 | COLD-ROLLED STEEL SHEET | 0.7 | 3.6 | 162 | 303 | 53 | 2.4 | 1.3 | EXAMPLES OF THE INVENTION |
| B14 | COLD-ROLLED STEEL SHEET | 0.7 | 2.1 | 158 | 309 | 52 | 2.5 | 1.3 | |
| B15 | GALVANEALING COLD-ROLLED STEEL SHEET | 0.7 | 3.3 | 166 | 302 | 52 | 2.3 | 1.4 | |

What is claimed is:

1. A steel sheet having a first surface, a second surface, and a thickness for press working that exhibits excellent stiffness and satisfactory press workability, the steel sheet for press working comprising:

0.007 to 1.0 wt % of C+N+B in a region from at least one of first and second surfaces of said steel sheet to a position of 5% of the thickness in a direction perpendicular to the first and second surfaces;

a pole intensity of $[\{321\}+\{211\}]/\{100\} \geqq 1.2$ in the direction perpendicular to at least one of the first and second of first and second surfaces; and less than 0.010 wt. % of C+N+B in a central region located from a first position of 30% from the first surface in the direction perpendicular to the first surface to a second position of 30% from the second surface in the direction perpendicular to the second surface.

2. A steel sheet for press working that exhibits excellent stiffness and satisfactory press workability according to claim 1, wherein the average composition in the overall portion in the direction perpendicular to the first and second surfaces comprises:

1.0 wt % or less of C;
2.0 wt % or less of Si;
3.0 wt % or less of Mn;
0.3 wt % or less of P;
0.1 wt % or less of S;
one or more elements selected from a group consisting of the following elements:
0.01 to 2.0 wt % Cr,
0.01 to 2.0 wt % Ni,
0.01 to 2.0 wt % Mo,
0.002 to 0.2 wt % V,
0.002 to 0.2 wt % Ti,
0.002 to 0.2 wt % Nb,
0.01 to 2.0 wt % Cu,
0.002 to 0.2 wt % Zr,
0.001 to 0.1 wt % Sb,
0.001 to 0.1 wt % Se,
0.001 to 0.1 wt % Ca, and
0.001 to 0.2 wt % Al; and
a balance consisting of Fe and unavoidable impurities.

3. The steel sheet for press working that exhibits excellent stiffness and satisfactory press workability according to claim 1, wherein the amounts of C+N+B from at least one of the first and second surfaces to the 5% thickness position are 0.010 to 0.9 wt % and the pole intensity at the 3% thickness position is $[\{321\}+\{211\}]/\{100\} \geqq 1.5$.

4. The steel sheet for press working that exhibits excellent stiffness and satisfactory press workability according to claim 3, wherein the average composition in the overall portion in the direction of the thickness comprises:

1.0 wt % or less of C;
2.0 wt % or less of Si;
3.0 wt % or less of Mn;
0.3 wt % or less of P;
0.1 wt % or less of S;
one or more elements selected from a group consisting of the following elements:
0.01 to 2.0 wt % Cr,
0.01 to 2.0 wt % Ni,
0.01 to 2.0 wt % Mo,
0.002 to 0.2 wt % V,
0.002 to 0.2 wt % Ti,
0.002 to 0.2 wt % Nb,
0.01 to 2.0 wt % Cu,
0.002 to 0.2 wt % Zr,
0.001 to 0.1 wt % Sb,
0.001 to 0.1 wt % Se,
0.001 to 0.1 wt % Ca, and
0.001 to 0.2 wt % Al; and
a balance consisting of Fe and unavoidable impurities.

5. A method of manufacturing a hot-rolled steel sheet for press working that exhibits excellent stiffness and satisfactory press workability comprising the steps of:

subjecting, to hot rolling, a slab comprising:
less than 0.010 wt % of C+N+B;
2.0 wt % or less of Si;
3.0 wt % or less of Mn;
0.3 wt % or less of P;
0.1 wt % or less of S;
one or more elements selected from a group consisting of the following elements:
0.01 to 2.0 wt % Cr,
0.01 to 2.0 wt % Ni,
0.01 to 2.0 wt % Mo,
0.002 to 0.2 wt % V,
0.002 to 0.2 wt % Ti,
0.002 to 0.2 wt % Nb,
0.01 to 2.0 wt % Cu,
0.002 to 0.2 wt % Zr,
0.001 to 0.1 wt % Sb,
0.001 to 0.1 wt % Se,
0.001 to 0.1 wt % Ca, and
0.001 to 0.2 wt % Al; and
a balance consisting of Fe and unavoidable impurities, said hot rolling being performed at a temperature ranging in $Ar_3 \pm 70°$ C. while making a total reduction ratio of 50% or more and a friction coefficient to 0.25 or less; and
performing carburizing, nitriding and boronizing to cause at least one region of the steel sheet from at least one of the first and second surfaces to a position of 5% of the thickness in a direction perpendicular to the first and second surfaces to have a composition expressed by C+N+B=0.007 to 10 wt %.

6. A method of manufacturing a cold-rolled steel sheet for press working that exhibits excellent stiffness and satisfactory press workability according to claim 5, further comprising the steps of:

cold rolling after said hot rolling while making a reduction ratio 7% or more and a friction coefficient 0.12 or less; and
performing re-crystallization annealing continuously during said carburizing, nitriding and boronizing.

7. A method of manufacturing a cold-rolled steel sheet for press working that exhibits excellent stiffness and satisfactory press workability according to claim 5, further comprising the steps of:

cold rolling while making a reduction ratio 7% or more and a friction coefficient 0.12 or less; and
performing re-crystallization annealing before said carburizing, nitriding and boronizing are performed.

8. A steel sheet, having a surface and a thickness, for press working that exhibits excellent stiffness and satisfactory press workability, the steel sheet for press working comprising:

0.007 to 1.0 wt % of C+N+B in a region from the surface of said steel sheet to a position of 5% of the thickness in a direction perpendicular to the surface;
a pole intensity of $[\{321\}+\{211\}]/\{100\} \geqq 1.2$ in the direction perpendicular to the surface realized at a position of 3% thickness in a direction perpendicular to the surface; and less than 0.010 wt % of C+N+B in a central region located between a first position of 30% from the surface and a second position 70% from the surface in the direction perpendicular to the surface.

9. A steel sheet for press working that exhibits excellent stiffness and satisfactory press workability according to claim 8, wherein the average composition in the overall portion in the direction perpendicular to the surface comprises:

1.0 wt % or less of C;
2.0 wt % or less of Si;
3.0 wt % or less of Mn;
0.3 wt % or less of P;
0.1 wt % or less of S;
one or more elements selected from a group consisting of the following elements:
0.01 to 2.0 wt % Cr,
0.01 to 2.0 wt % Ni,
0.01 to 2.0 wt % Mo,
0.002 to 0.2 wt % V,
0.002 to 0.2 wt % Ti,
0.002 to 0.2 wt % Nb,
0.01 to 2.0 wt % Cu,
0.002 to 0.2 wt % Zr,
0.001 to 0.1 wt % Sb,
0.001 to 0.1 wt % Se,
0.001 to 0.1 wt % Ca, and
0.001 to 0.2 wt % Al; and
a balance consisting of Fe and unavoidable impurities.

10. The steel sheet for press working that exhibits excellent stiffness and satisfactory press workability according to claim 8, wherein the amounts of C+N+B at the 5% thickness position are 0.010 to 0.9 wt % and the pole intensity at the 3% thickness position is $[\{321\}+\{211\}]/\{100\} \geqq 1.5$.

11. The steel sheet for press working that exhibits excellent stiffness and satisfactory press workability according to claim 10, wherein the average composition in the overall portion in the direction of the thickness comprises:

1.0 wt % or less of C;
2.0 wt % or less of Si;
3.0 wt % or less of Mn;
0.3 wt % or less of P;
0.1 wt % or less of S;
one or more elements selected from a group consisting of the following elements:
0.01 to 2.0 wt % Cr,
0.01 to 2.0 wt % Ni,
0.01 to 2.0 wt % Mo,
0.002 to 0.2 wt % V,
0.002 to 0.2 wt % Ti,
0.002 to 0.2 wt % Nb,
0.01 to 2.0 wt % Cu,
0.002 to 0.2 wt % Zr,
0.001 to 0.1 wt % Sb,
0.001 to 0.1 wt % Se,
0.001 to 0.1 wt % Ca, and
0.001 to 0.2 wt % Al; and
a balance consisting of Fe and unavoidable impurities.

* * * * *

UNITED STATES PATENT AND TRADEMARK OFFICE

CERTIFICATE OF CORRECTION

PATENT NO. : 5,372,654

DATED : December 13, 1994

INVENTOR(S) : Susumu SATOH

It is certified that error appears in the above-indentified patent and that said Letters Patent is hereby corrected as shown below:

Column 11, Line 5, after "second" (first occurrence) insert --surfaces realized at a position of 3% thickness from at least one--.

Column 12, Line 37, (Claim 5, line 35), "10" should be --1.0--.

Signed and Sealed this

Thirteenth Day of June, 1995

*Attest:*

Bruce Lehman

BRUCE LEHMAN

*Attesting Officer*

*Commissioner of Patents and Trademarks*